US006875118B1

(12) United States Patent
Checketts

(10) Patent No.: US 6,875,118 B1
(45) Date of Patent: Apr. 5, 2005

(54) PNEUMATICALLY ACTUATED SWING RIDE

(75) Inventor: Stanley J. Checketts, Providence, UT (US)

(73) Assignee: S & S Worldwide, Inc., Logan, UT (US)

( * ) Notice: Subject to any disclaimer, the term of this patent is extended or adjusted under 35 U.S.C. 154(b) by 0 days.

(21) Appl. No.: 10/845,201

(22) Filed: May 13, 2004

(51) Int. Cl.[7] ..... A63G 9/16
(52) U.S. Cl. ..... 472/119; 472/125; 472/134
(58) Field of Search ..... 472/44, 45, 118, 472/119, 125, 134; 297/273

(56) References Cited

U.S. PATENT DOCUMENTS 3,692,305 A * 9/1972 Allen ..... 472/119
5,573,465 A * 11/1996 Kitchen et al. ..... 472/118
5,827,124 A * 10/1998 Kleimeyer et al. ..... 472/45
5,989,127 A * 11/1999 Kitchen et al. ..... 472/44
6,110,048 A * 8/2000 Murray ..... 472/16

* cited by examiner

*Primary Examiner*—Kien Nguyen
(74) *Attorney, Agent, or Firm*—Richard D. Clarke

(57) ABSTRACT

The present invention is directed to a pneumatically actuated swing ride that has rigid swing members rotating about a shaft in a pendulum style of swinging ride. The ride operates with rigid swing members raising one or more riders in a seat platform or gondola up and then accelerates them down through an arc in the pendulum style of swinging movement. The controlled upward movement, a brief delay, and the accelerated downward movement produce weightlessness in the ride that is unmatched in the industry. The weightless effect is incurred at both ends of the arc and every time the cycle is made. By using a pneumatic cylinder, air is used as an air cushion both accelerating and decelerating the ride, giving complete control of the ride.

26 Claims, 6 Drawing Sheets

PNEUMATICALLY ACTUATED SWING RIDE

FIELD OF THE INVENTION

This invention relates to the field of amusement rides commonly found at carnivals, fairs and family amusement centers. More specifically this patent deals with a unique pneumatically actuated swing ride that raises the riders in an upward motion then with a delay, accelerates the riders in the downward travel of the swing faster than the natural speed occurred with the gravitational pull on the riders.

BACKGROUND OF THE INVENTION

Wide varieties of swing rides exist in the field of amusement rides that have many different swinging characteristics. Some of these rides use large hydraulic and electric motors operating through sophisticated gear and cable systems to facilitate an artificial swinging or tumbling action. Others use similar mechanisms to raise the riders to a position to be released, relying upon gravity and the weight of the riders to be transported through a pendulum type of swinging ride. This style of ride relies upon the natural decreasing swinging of the riders to bring them to a position where they can be stopped and removed to start another ride sequence. Still others use cables in combination with bungee or elastic cords to achieve a bouncing element into the swinging of the riders. In general, large amusement thrill rides use large hydraulic and electric motors operating through sophisticated gear and cable systems to produce a variety of articulating movements.

This invention describes a new and unique pneumatically actuated swing ride. This inventor, being an expert in the field of extreme amusement thrill rides, has learned through experience that safety of the ride is the most important aspect of any thrill ride. With all the safety requirements of the ride fulfilled, the next important item is to give the riders a new and exciting unique ride. With the pneumatically actuated swing ride the inventor has achieved his goal by creating a swing ride that operates on rigid swing members that raise the riders up and then accelerates them down in the pendulum style of swinging movement through an arc as many times as desired. The controlled upward movement, a brief delay, and the accelerated downward movement produce weightlessness in the ride that is unmatched in the industry. When riders are released to have just the effect of gravity for the swinging action, they do not have the feeling of weightlessness and the ride is progressively slower for each swing cycle.

U.S. Pat. No. 5,989,127 of William Joel Ketchen et al. describes an amusement ride including a tower that pivotably supports an elongated boom that includes an extended end and a pivot. A passenger carriage is pivotably attached to the extended end of the boom. The shorter end of the boom includes a moveable counterweight that is operable for raising the boom. The boom is then locked, the counterweight is moved, and the boom is released to swing freely. The movable counterweight includes first and second storage tanks, a counterweight fluid, and at least one pump for moving the counterweight fluid between the first and second storage tanks. Passengers are loaded into the passenger carriage when the boom is in the down position. The boom is then raised by moving the counterweight fluid into the first storage tank. After the boom is raised, a brake is set to lock the boom in the raised position, and the counterweight fluid is moved into the second storage tank. The operator then lowers the boom by releasing the brake. The boom swings through approximately 270-degrees, and the passenger carriage may make a 360-degree loop at the end of the first swing.

This patent describes an amusement ride including a tower that pivotably supports an elongated boom. It has a high degree of sophisticated machinery and apparatus on the elevated levels of the device, which make it extremely difficult to maintain. The ride produces only a variety of swinging movements and does not give the prolonged feeling of weightlessness.

U.S. Pat. No. 5,842,928 of Henry J. McGinnis describes an amusement ride that provides a very large swing. The ride has a tower with two spaced apart legs connected at the upper ends by a cross-member. A boom extends perpendicular to the cross-member at the upper end of the tower. A swing line is secured to one end of the boom and has a harness at its lower end. A carriage rolls on a track along the lower side of the boom. The carriage has an engagement member, which will engage the swing line and cause it to take up toward the opposite end of the boom, lifting the passenger. Once the passenger is at the desired elevation, the engagement member releases the swing line, allowing the passenger to swing between the legs of the tower.

This patent describes an amusement ride that provides a very large swing. There are many varieties of this style of ride, some called sky coasters. They achieve great elevations and are very exciting to ride, but when released from their initial elevated position, the riders go through a progressively decreasing pendulum motion until the ride is over. Again, this device does not give a complete feeling of weightlessness.

U.S. Pat. No. 5,649,866 of C. Grant Balwanz describes an amusement ride system that includes a chair assembly within which an occupant is seated during the course of a ride and first, second and third upstanding towers fixedly secured to the ground in a spaced and triangular relationship. A first pair of bungee cords are joined to one side of the chair assembly and have ends which extend toward the upper portion of the first tower, and a second pair of bungee cords are joined to the opposite side of the chair assembly and have ends which extend toward the upper portion of the second tower and a windable cable which is joined to each of the extending ends of the first and second pair of bungee cords for tensioning the bungee cords to a stretched condition. A pull cable is releasably joined to the back of the chair assembly for tensioning the pull cable by way of the upper portion of the third tower as the bungee cords are being pulled to the stretched condition so the chair assembly is lifted from the ground by the bungee cords and the pull cable to a position adjacent the upper portion of the third tower. By releasing the cable from the back of the chair assembly when the chair assembly is positioned adjacent the upper portion of the third tower as aforedescribed, the first and second pairs of bungee cords are permitted to throw the chair assembly along a substantially horizontal path extending from the third tower and between the first and second towers.

This patent describes another amusement ride that provides a very large swing with the addition of the bungee cords. The ride also can achieve great elevations and some degree of weightlessness as the bungee reaches uppermost position, but again goes through a progressively decreasing motion until the ride is over. The duration of the ride cannot be controlled and there again this device does not give a repeated feeling of weightlessness derived by the pneumatically actuated swing ride.

U.S. Pat. No. 5,188,566 of Karl Bohme describes The passenger gondola of a looping swing suspended in pendulum fashion on motor-driven outriggers that has parallel rows of passenger seats that are disposed parallel to the axis of rotation of the outriggers and to the axis of swing of the passenger gondola. Here, the head rests of the passenger seats are a short distance from the axis of swing in order to hold the acceleration forces acting on the passengers, which occur with looping over of the passenger gondola.

Preferably, the position of the passenger gondola relative to the outriggers is locked at a particular angular position. The ride activity is then operated such that the gondola locks in the tilted, forward direction of rotation, and locking is released at about the top dead center point of outrigger rotation, so that the passenger gondola executes a loop on the outriggers overtaking it.

This patent describes a gondola of a looping swing suspended in pendulum fashion on motor-driven outriggers that has parallel rows of passenger seats. This ride, most commonly found in carnivals and fairs, represents the highly sophisticated mechanical rides that can be transported to different locations. These rides handle a large number of people for a controlled time and are not commonly found permanently anchored to the ground. They do not normally reach elevations greater than thirty feet.

U.S. Pat. No. 5,267,906 of William J. Ketchen et al. describes a ride that is capable of raising a rider to a height of thirty feet or more above the ground, and then releasing the rider to swing. It includes a support structure, a support line secured to the support structure at one end, with an opposed end secured to a rider, preferably to an attachment, which is worn by a rider. A launch structure is spaced from the support structure and carries a launch line which has an end capable of being raised and lowered above the ground, and which is designed to be releasably attached to the rider attachment to lift a rider from the ground. A release device is located between the launch line and the rider attachment. In operation, the rider attachment with the support line attached is secured to the rider, the launch line is releasably secured to the attachment, and the launch line is activated to move the rider laterally and upwardly towards the top of the launch structure. When the launch line is released from the attachment, which carries the rider, the rider swings downwardly at a high speed simulating the sensation of "body flight" in a pendulum like motion until slowing to a speed at which he or she may remove the attachment. In an alternative mode of operation, the rider may be lifted up the launch structure, and the support line secured to the rider, with the rider then swinging off the launch structure.

This patent describes a ride that is capable of raising a rider to a height of thirty feet or more above the ground, and then releasing the rider to swing. This is still another swing ride where the riders go through a progressively decreasing pendulum motion until the ride is over, and does not give a complete feeling of weightlessness.

None of the foregoing prior art teaches or suggests the particular unique features of the pneumatically actuated swing ride and thus this clarifies the need for further improvements and refinements in the field of thrill rides used in theme parks, fairs and family fun centers.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

SUMMARY OF THE INVENTION

The principle object of this invention is to create a safe pneumatically actuated pendulum style swing ride.

Another object of this invention is to create a swing ride with rigid swing members that in alternate embodiments may be activated by a variety of electric motors, gas motors and hydraulic drive units for the desired effects.

Another object of this invention is to create a pneumatically actuated swing ride that will achieve the effect of prolonged weightlessness from the top until the riders reach the bottom of the arc and begin to move up to the other side.

Another object of this invention is to create a pneumatically actuated swing ride that will use the air in one or more pneumatic cylinders at the top or the bottom of the swing support columns or towers as a cushion to control both the acceleration and deceleration of the riders.

Another object of this invention is to create a pneumatically actuated swing ride that can be easily adjusted from a high-speed ride to a modest-speed ride during the ride or between rides.

Another object of this invention is to create a pneumatically actuated swing ride that can give the same prolonged feeling of weightlessness during each cycle of the ride.

Another object of this invention is to create a pneumatically actuated swing ride that can have a controlled deceleration after the ride is over so that the operators may determine the number of cycles in each ride.

Another object of this invention is to create a thrill ride that upon any unforeseen failure, the riders will return to the bottom of the arc to the unloading position.

Still another object of this invention is to create a pneumatically operated swing ride that can optionally be operated by the means of using the ends of a single cable or the ends of two separate cables attached to two sheaves on the rotational shaft, allowing and maintaining the limited travel required.

A further object of this invention is to create a pneumatically actuated swing ride that can range in height from twenty feet to in excess of one hundred and fifty feet high or more.

Yet another object of this invention is to create a pneumatically actuated swing ride that can be permanently anchored to the ground or adapted to a portable trailer unit while producing a similar prolonged weightless effect for the riders.

A final object of this invention is to add a new and unique pneumatically actuated swing ride to the area of thrill rides used in theme parks, fairs and family fun parks where customers always want new thrill rides.

The preferred embodiment of the pneumatically actuated swing ride will be anchored in the ground by conventional concrete footings. Swing support columns, or towers will be held in position by forward guy cables, rear guy cables and side guy cables. The swing support columns or towers may optionally be held in place by rigid piping or any other conventional structural supporting members. At the upper distal ends of the swing support columns or towers are bearing mounting plates on which pillow block bearings are mounted, housing the rotational shaft that is parallel to the ground. Centrally located and spaced apart are two seat platform stabilizing yokes, consisting of a forward yoke arm and a rear yoke arm and a fixture for mounting the upper distal end of the rigid swing members. The seat platform stabilizing yokes are rigidly attached to the rotational shaft where they rotate in unison with the rotational shaft. The rigid swing members are connected at their lower distal end to a seat platform consisting of one or more passenger seats with optional foot rests and conventional shoulder restraints, seat belts or lap bars. A forward stabilizing cable and a rear stabilizing cable maintain the rigidity of the seat platform. On the preferred embodiment of the pneumatically actuated swing ride a lever arm is rigidly attached at the distal end of the rotational shaft so that when the swing is at the maximum rear elevation, the pneumatic cylinder rod of the pneumatic cylinder passes by the distal end of the rotational shaft. Compressed air is supplied to the pneumatic cylinder by the means of air hoses that are connected to the air compressor through a series of conventional valves. A computer controlled control console on top of the air compressor will control the speed and height of the swing ride and the duration of the ride by the means of a variety of conventional air valves.

A first alternate embodiment of the pneumatically actuated swing ride will have the rigid swing members spread apart where the seat platform stabilizing yokes are adjacent to the pillow block bearings. A support beam will cross over between two risers allowing clearance for the seat platform stabilizing yokes, and mounted above the pillow block bearings on the swing support columns.

A second alternate embodiment of the pneumatically actuated swing ride will replace the lever arm that is rigidly attached at the distal end of the rotational shaft with one or more cable sheaves or a chain sprocket that will be rigidly attached at the distal end of the rotational shaft. When two sheaves are used, two separate cables will be fixably attached to the sheaves by the means of cable clamps allowing only the limited rotation required by the device. A cable or a cable and chain combination will activate the rigid swing members and in turn, the passenger seat platform by the means of the pneumatic cylinder coupled in line with the cable or a cable and chain combination.

A third alternate embodiment of the pneumatically actuated swing ride will us two small cylinders and a combination of pulleys to achieve the same unique swinging features. By using two cylinders instead of having the single cylinder, smaller cylinders with a shorter stroke can be used. An additional option of using the combination of pulleys the travel of the sprocket will be the same for the desired oscillating swing motion. The two upper pulleys will be attached to a pulley-mounting platform attached to the swing support column, with the opposing pulleys attached to the pneumatic cylinder rods.

It must be clearly understood at this time although the preferred embodiment of the invention consists of the pneumatic actuating means, that many conventional mechanical actuating devices exist, including electric motors, gas powered motors, hydraulic motors and hydraulic cylinders, or combinations thereof, that will achieve the a similar operation and they will also be fully covered within the scope of this patent.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

For a fuller understanding of the nature and objects of the invention, reference should be had to the following detailed description taken in conjunction with the accompanying drawings which are incorporated in and form a part of this specification, illustrate embodiments of the invention and together with the description, serve to explain the principles of this invention.

DETAILED DESCRIPTION OF THE PREFERRED EMBODIMENTS

Figure 1:
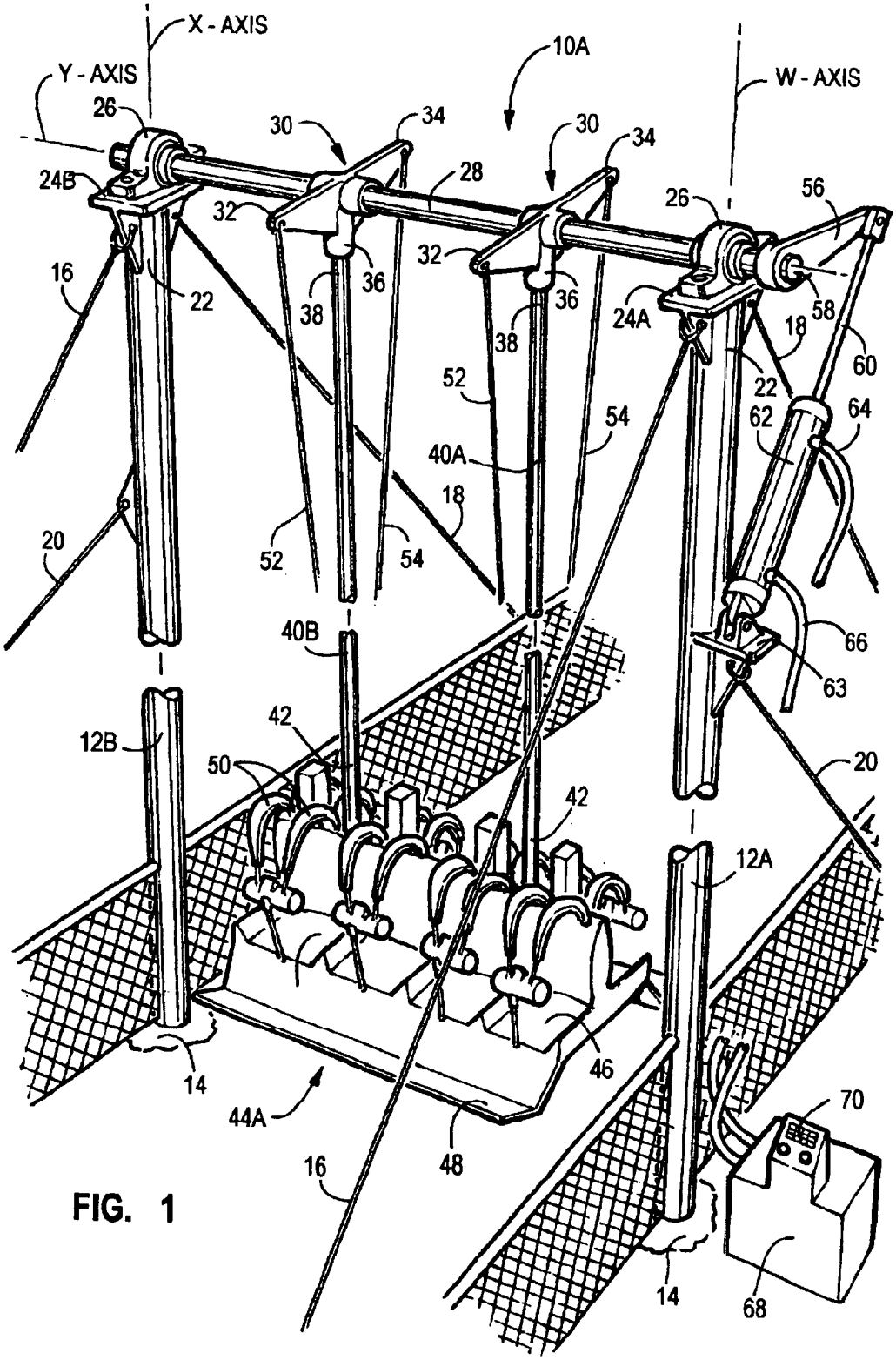
FIG. 1 depicts a perspective view of the pneumatically actuated swing ride.

For a fuller understanding of the nature and objects of the invention, reference should be had to the following detailed description taken in conjunction with the accompanying drawings wherein similar parts of the invention are identified by like reference numerals. There is seen in FIG. 1 a perspective view of the preferred embodiment of the pneumatically actuated swing ride 10A illustrating the swing support columns 12A and 12B anchored in the ground by conventional concrete footings 14 and perpendicular to the surface of the ground on axes W and X. The swing support columns 12A and 12B are held in position by forward guy cables 16, rear guy cables 18 and side guy cables 20. At the distal upper ends 22 of the swing support columns, 12A and 12B are bearing mounting plates 24A and 24B on which pillow block bearings 26 are mounted housing the rotational shaft 28 that is parallel to the ground on Y axis. It must be understood that any form of bearing block or bushing will perform the same function as the pillow block bearings 26 and all will be covered within the scope of this patent. Centrally located and spaced apart are two seat platform stabilizing yokes 30 consisting of a forward yoke arm 32 and a rear yoke arm 34 and a fixture 36 for mounting the upper distal end 38 of the rigid swing members 40A and 40B. The seat platform stabilizing yokes 30 are rigidly attached to the rotational shaft 28 where they rotate in unison with rotational shaft 28. The rigid swing members 40A and 40B are connected at their lower distal end 42 to a passenger seat platform 44A consisting of one or more passenger seats 46 with footrests 48 and conventional shoulder restraints 50. A forward stabilizing cable 52 and a rear stabilizing cable 54 maintain the rigidity of the passenger seat platform 44A. Lever arm 56 is rigidly attached at the distal end 58 of the rotational shaft 28 so that when the swing is at the maximum rear elevation, Illustrated in FIG. 3, that the pneumatic cylinder rod 60 of the pneumatic cylinder 62 passes by the distal end 58 of the rotational shaft 28. The weight of the passengers and the passenger seat platform 44A, cause the delay and reverse action to travel back down the arc. Compressed air is supplied to the pneumatic cylinder 62 by the means of air hoses 64 and 66 that are connected to the air compressor 68 through a series of conventional valves. The pneumatic cylinder 62 is attached to the swing support column 12A by the means of the pneumatic cylinder support bracket 63. Again at this time it must be understood that one or more pneumatic cylinders 62 could function in the rotational operation of the pneumatically actuated swing ride 10A or 10B and still be covered within the scope of this patent. A computer controlled control console 70 is illustrated on top of the air compressor 68 that will control the speed and height of the swing ride 10A or 10B and the duration of the ride by the means of a variety of conventional air valves.

Figure 2:
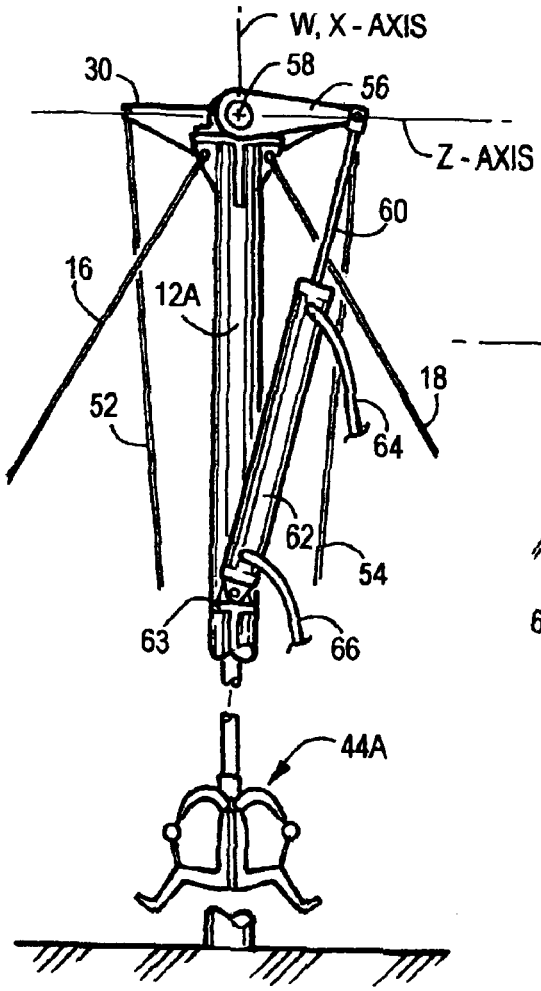
FIG. 2 depicts a side elevation of the pneumatically actuated swing ride with the passenger seat platform in the loading position.
Figure 3:
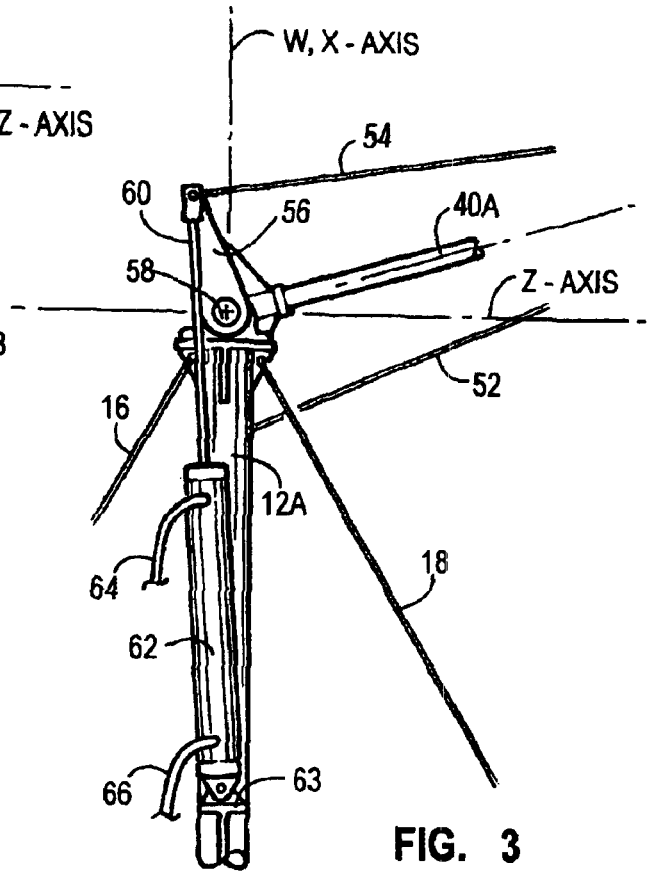
FIG. 3 depicts a side elevation of the upper portion of the pneumatically actuated swing ride with the rigid swing member in the maximum rear elevation.
Figure 4:
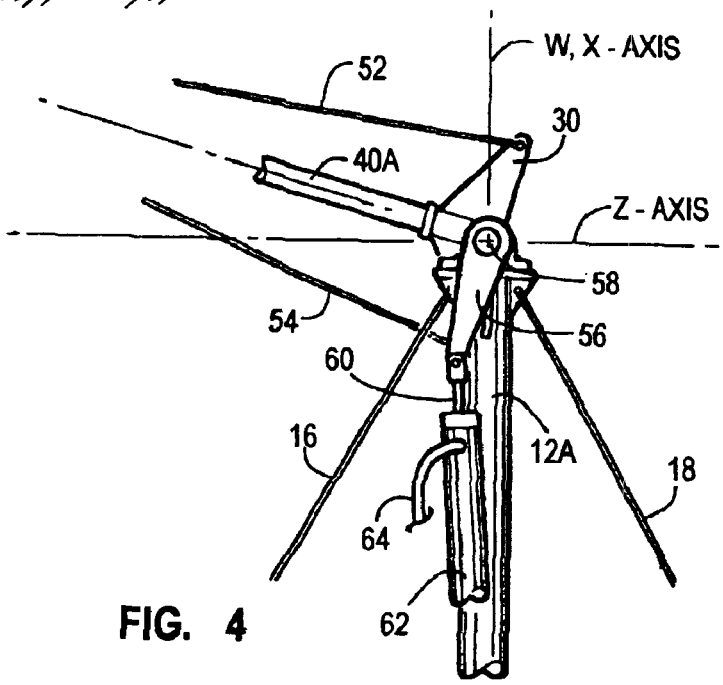
FIG. 4 depicts a side elevation of the upper portion of the pneumatically actuated swing ride with the rigid swing member in the maximum forward elevation.

FIG. 2 depicts a side elevation of the pneumatically actuated swing ride 10A with the passenger seat platform 44A in the loading position indicating the mid location of the lever arm 56, the pneumatic cylinder 62 and the rigid swing members 40A and 40B with the passenger seat platform 44A. FIG. 3 depicts a side elevation of the upper portion of the pneumatically actuated swing ride 10A with the rigid swing members 40A and 40B in the maximum rear elevation and the lever arm 56 passing by the distal end 58 of the rotational shaft 28. The maximum rear elevation of the rigid swing members 40A and 40B is 23-degrees above the Z axis, which is parallel with the ground. FIG. 4 depicts a side elevation of the upper portion of the pneumatically actuated swing ride 10A with the rigid swing members 40A and 40B in the maximum forward elevation.

Figure 5:
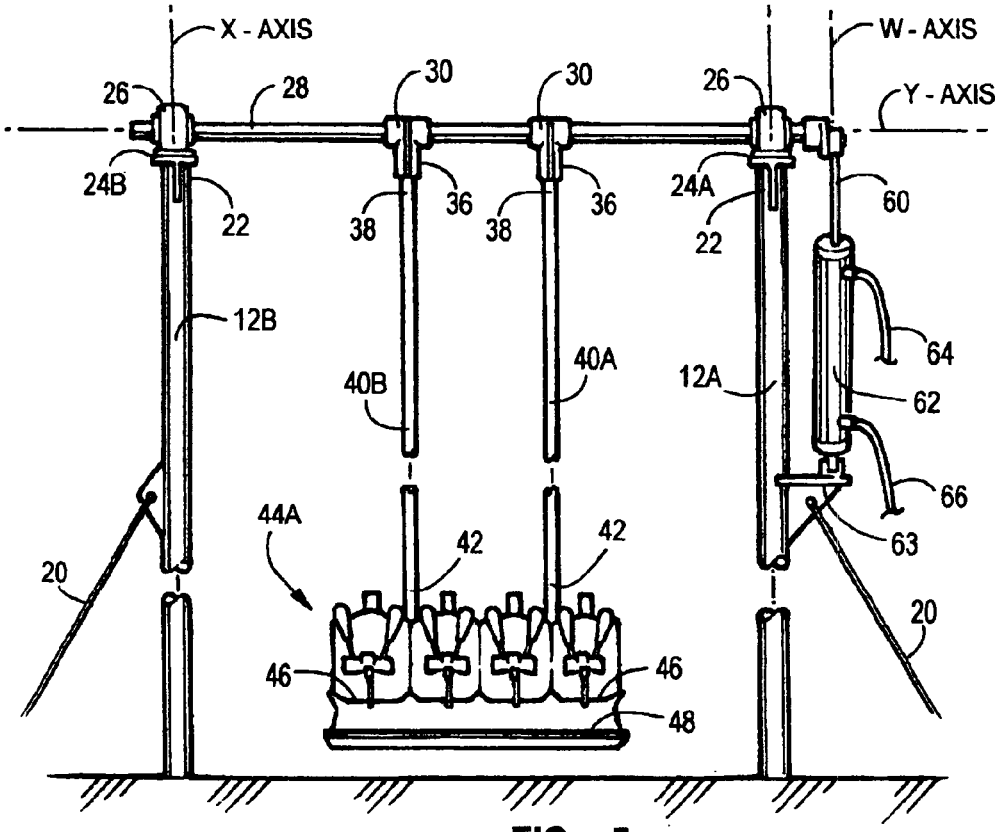
FIG. 5 depicts a front elevation of the pneumatically actuated swing ride.

FIG. 5 depicts a front elevation of the pneumatically actuated swing ride 10A further illustrating the central spaced apart location of the two seat platform stabilizing yokes 30 with the fixtures 36 mounting the upper distal end 38 of the rigid swing members 40A and 40B.

Figure 6:
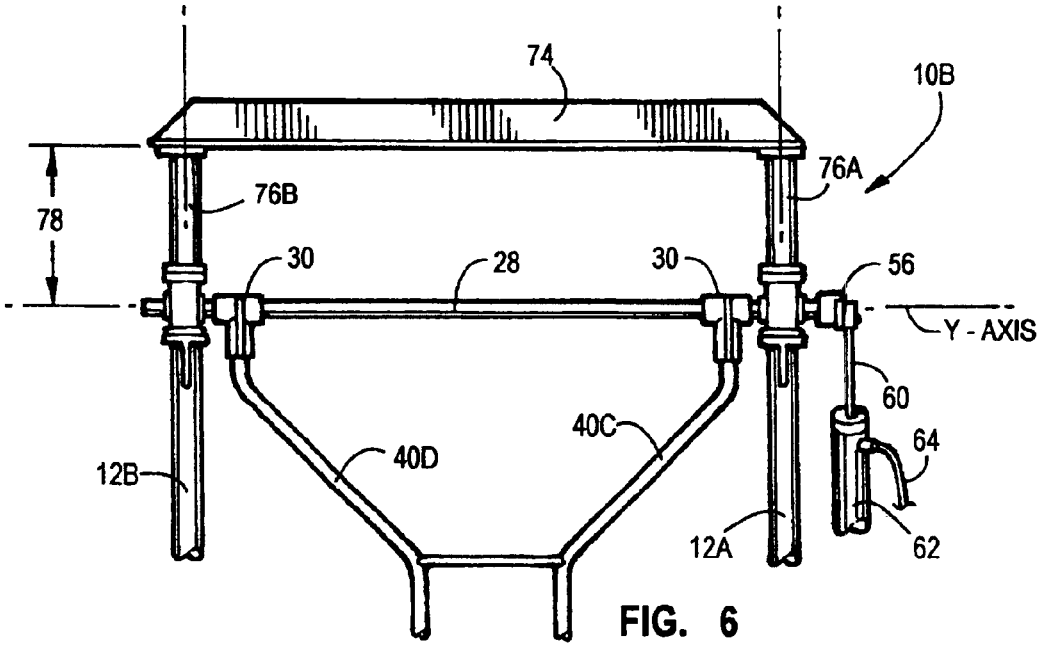
FIG. 6 depicts a front elevation of the first alternate embodiment of the pneumatically actuated swing ride with the spread rigid swing members and a support beam between the two swing support columns.

FIG. 6 depicts a front elevation of the alternate embodiment of the pneumatically actuated swing ride 10B with the spread apart rigid swing members 40C and 40D where the seat platform stabilizing yokes 30 are adjacent to the pillow block bearings 26. A support beam 74 crosses over between two risers 76A and 76B allowing clearance for the seat platform stabilizing yokes 30 and mounted above the pillow block bearings 26 on the swing support columns 12A and 12B. The height 78 of the risers 76A and 76B allows that the forward yoke arm 32 and the rear yoke arm 34 have adequate clearance.

Figure 7:
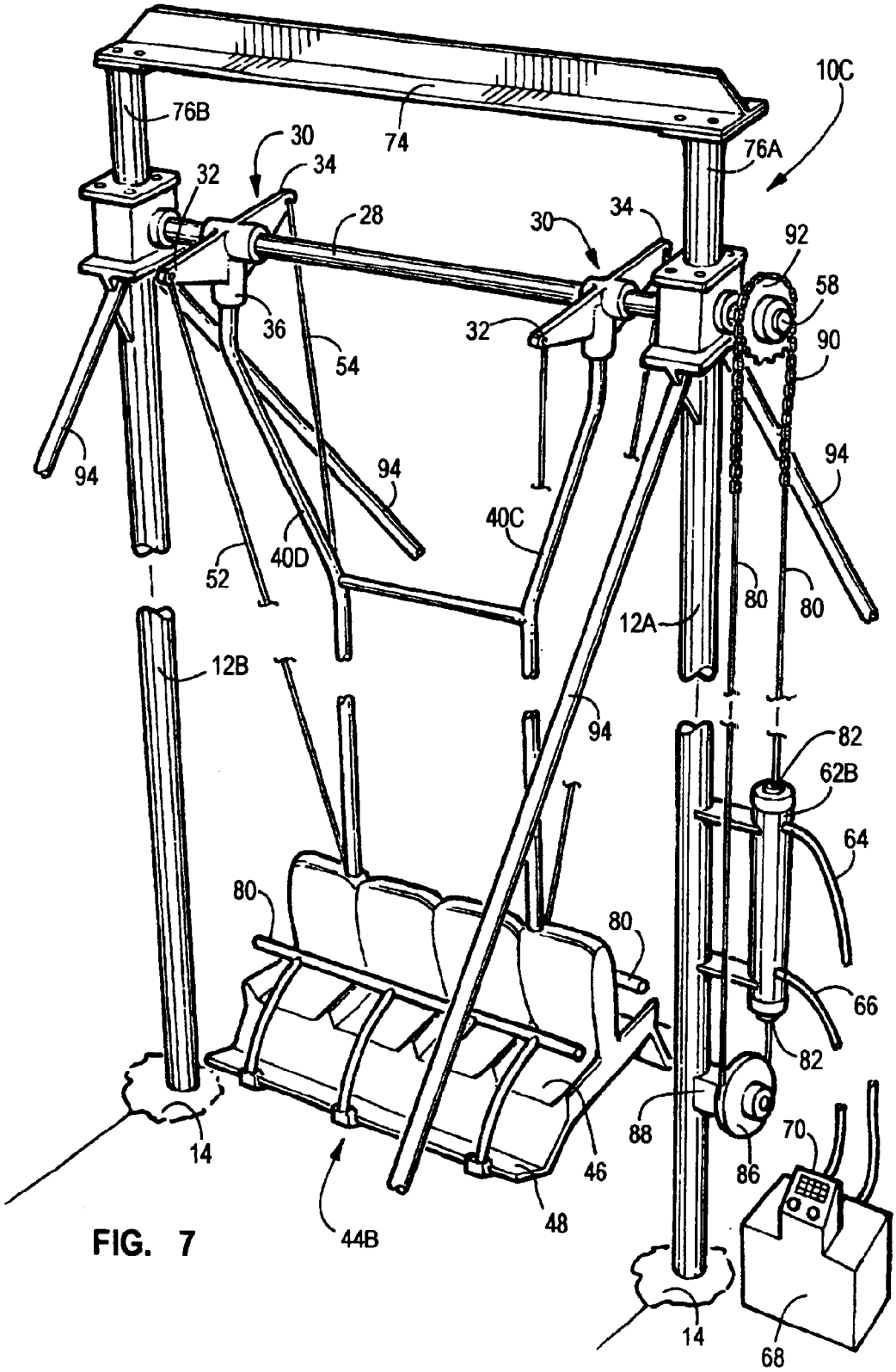
FIG. 7 depicts a perspective view of the second alternate embodiment of the pneumatically actuated swing ride with the spread apart rigid swing members, the seat platform equipped with a conventional lap bar and the pneumatic cylinder in line with the actuating cable.

FIG. 7 depicts a perspective view of the second alternate embodiment of the pneumatically actuated swing ride 10C with the spread apart rigid swing members 40C and 40D, the seat platform 44B equipped with a conventional lap bar 80 and the pneumatic cylinder 62B in line with the actuating cable 82. The unique features of the pneumatic cylinder 62B allows that an actuating cable 82 be attached at both sides of the piston within the pneumatic cylinder 62B and is drawn through seals 84 at either end of the pneumatic cylinder 62B forming effective air bearings. Actuating cable 82, illustrated in FIG. 7, goes over a sheave 86 attached to a bracket 88 at the lower end of the support column 12A and is attached to a roller chain 90 to go over a sprocket 92 that is fixably attached to the distal end of the rotational shaft 58. Also depicted are rigid bracing members 94 replacing the guy cables 16, 18 and 20. It must be understood that the a variety of pneumatic cylinders 62B can be put in a variety of positions with any number of sheaves 86, sprockets 92 and cables and still be covered within the scope of this patent.

Figure 8:
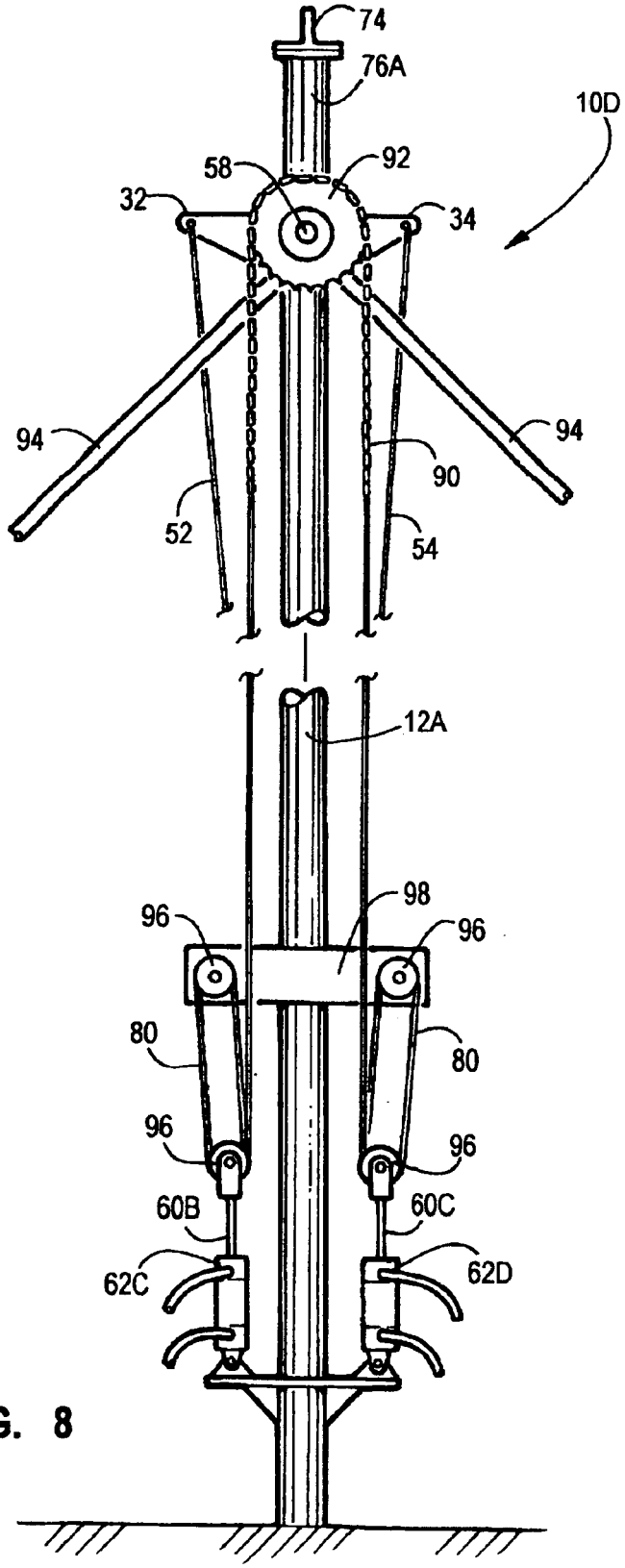
FIG. 8 depicts a side view of the third alternate embodiment of the pneumatically actuated swing ride using two small cylinders and a combination of pulleys to achieve the same swinging features.

FIG. 8 depicts a side view of the third alternate embodiment of the pneumatically actuated swing ride 10D using two small cylinders 62C and 62D and a combination of pulleys 96 to achieve the same unique swinging features. By using two cylinders 62C and 62D instead of having the single cylinder 62A or 62*b*, with the option of shortening the stroke on two cylinders 62C and 62D and using the combination of pulleys 96 the travel of the sprocket 92 will be the same for the desired oscillating swing motion. The two upper pulleys 96 will be attached to a pulley mounting platform 98 attached to the swing support column 12A, with the opposing pulleys 96 attached to the pneumatic cylinder rod 60B and 60C.

Figure 9:
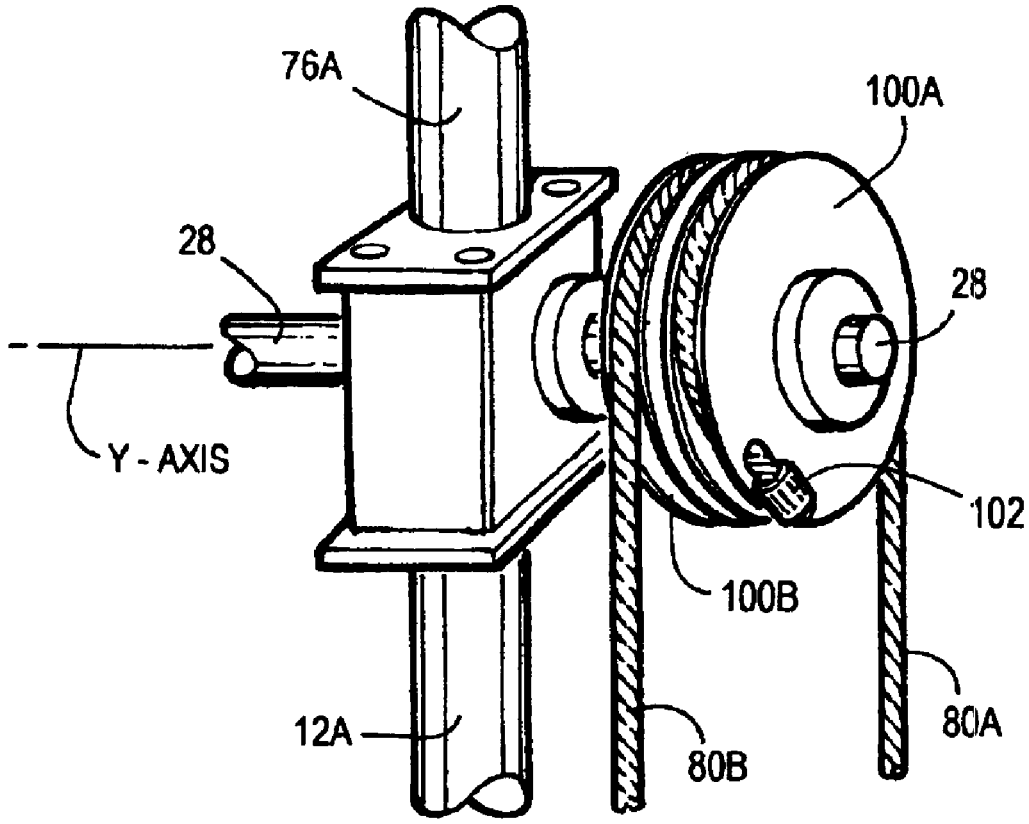
FIG. 9 depicts two sheaves attached to the rotational shaft with the ends of a single cable or the ends of two separate cables attached to the two sheaves allowing the limited travel required for the device.

FIG. 9 depicts two sheaves attached to the rotational shaft 28 on the Y-axis with the ends of a single cable 80 or the ends of two separate cables 80A and 80B attached to the two sheaves 100A and 100B allowing and maintaining the limited rotational travel required for the device.

The pneumatically actuated swing ride 10A and 10B shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed for providing a pneumatically actuated swing ride 10 and 10B in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A pneumatically actuated swing ride comprising:

a) base means for supporting vertical swing support columns;

b) passenger containment and securing means including a passenger containment platform supporting one or more passenger containment and securing devices;

c) shaft means rotationally attached to said vertical swing support columns, including passenger containment and securing means stabilizing yokes attached to rigid swing members extending down and fixed to said passenger containment and securing means; and d) one or more pneumatic cylinder assemblies moveably attached to said shaft means by a lever arm which is rigidly attached to said shaft means;

whereby when said pneumatically actuated swing ride is in operation, said one or more pneumatic cylinder assemblies actuate the acceleration and the deceleration of said passenger containment and securing means in a safe and controlled manner.

2. The pneumatically actuated swing ride according to claim 1, wherein said base means includes a conventional concrete constructed base.

3. The pneumatically actuated swing ride according to claim 1, wherein said vertical swing support columns constructed of rigid piping which are held in position using a combination of forward guy cables, rear guy cables or side guy cables.

4. The pneumatically actuated swing ride according to claim 1, wherein said passenger containment and securing means includes passenger containment and securing devices which contain and secure the passenger in an upright position whereby the passenger is standing.

5. The pneumatically actuated swing ride according to claim 1, wherein said passenger containment and securing means includes passenger containment and securing devices which contain and secure the passenger in a seated position whereby the passenger is sitting.

6. The pneumatically actuated swing ride according to claim 1, wherein said passenger containment and securing means includes passenger containment and securing devices which contain and secure the passenger in a prone position whereby the passenger is lying.

7. The pneumatically actuated swing ride according to claim 5, wherein said passenger containment and securing means includes a passenger seat platform supporting passenger seats equipped with passenger safety restraint devices.

8. The pneumatically actuated swing ride according to claim 1, wherein said shaft means includes a rigid shaft member held in place horizontally parallel to the ground where said base means is located.

9. The pneumatically actuated swing ride according to claim 1, wherein said one or more air cylinder assemblies includes an air compressor, air hoses and air valves.

10. The pneumatically actuated swing ride according to claim 1, wherein said one or more air cylinder assemblies includes a computer control component for the purpose of controlling the speed and height of said swing ride as well as the duration of the ride via said conventional air hoses and air valves.

11. The pneumatically actuated swing ride according to claim 1, wherein said vertical swing support columns further includes a support beam rigidly attached to said vertical swing support columns in a horizontal position above said shaft means, for allowing clearance for said passenger containment and securing means stabilizing yokes, whereby said support beam adds strength and stability to the overall swing ride structure.

12. The pneumatically actuated swing ride according to claim 1, wherein said lever arm is removed and replaced with one or more cable sheaves rigidly attached to the distal end of said shaft means.

13. The pneumatically actuated swing ride according to claim 12, wherein said one or more air cylinder assemblies is attached to cables which are directed through said cable sheaves.

14. The pneumatically actuated swing ride according to claim 13, wherein said one or more air cylinder assemblies includes one or more air cylinder rods which are attached to cables which are directed through said cable sheaves.

15. The pneumatically actuated swing ride according to claim 14, wherein said cables are directed through said cable sheaves further comprises two cable sheaves attached to said shaft means whereby the ends of a single cable or the ends of two separate cables are attached to said two sheaves, thereby allowing the limited travel required for actuation of said pneumatically actuated swing ride.

16. The pneumatically actuated swing ride according to claim 14, wherein said cables are directed by one or more pulleys before being attached to said chains, said pulleys being supported by a pulley mounting platform.

17. The pneumatically actuated swing ride according to claim 1, wherein said lever arm is removed and replaced with one or more chain sprockets rigidly attached to the distal end of said shaft means.

18. The pneumatically actuated swing ride according to claim 17, wherein said one or more air cylinder assemblies is attached to chains which are directed through said chain sprockets.

19. The pneumatically actuated swing ride according to claim 18, wherein said one or more air cylinder assemblies includes one or more air cylinder rods which are attached to chains which are directed through said chain sprockets.

20. The pneumatically actuated swing ride according to claim 17, wherein said cables are attached to chains, and said chains are directed by chain sprockets.

21. A method for making a pneumatically actuated swing ride comprising the steps of:

a) providing base means for supporting vertical swing support columns;

b) providing passenger containment and securing means including a passenger containment platform supporting one or more passenger containment and securing devices;

c) providing shaft means rotationally attached to said vertical swing support columns, including passenger containment and securing means stabilizing yokes attached to rigid swing members extending down and fixed to said passenger containment and securing means; and d) providing one or more pneumatic cylinder assemblies moveably attached to said shaft means by a lever arm which is rigidly attached to said shaft means;

whereby when said pneumatically actuated swing ride is in operation, said one or more pneumatic cylinder assemblies actuate the acceleration and the deceleration of said passenger containment and securing means in a safe and controlled manner.

22. The method for making a pneumatically actuated swing ride according to claim 21, wherein said step of providing one or more pneumatic cylinder assemblies moveably attached to said shaft means by a lever arm which is rigidly attached to said shaft means, is deleted and replaced with the step of providing one or more pneumatic cylinder assemblies moveably attached to said shaft means by one or more cable sheaves which are rigidly attached to said shaft means.

23. The method for making a pneumatically actuated swing ride according to claim 22, wherein said one or more cable sheaves which are rigidly attached to said shaft means further comprises two sheaves attached to said shaft means, whereby the ends of a single cable or the ends of two separate cables are attached to the two sheaves, thereby allowing the limited travel required for actuating said pneumatically actuated swing ride.

24. The method for making a pneumatically actuated swing ride according to claim 21, wherein said step of providing one or more pneumatic cylinder assemblies moveably attached to said shaft means by a lever arm which is rigidly attached to said shaft means, is deleted and replaced with the step of providing one or more pneumatic cylinder assemblies having air cylinder rods moveably attached to one or more pulleys directing cables attached to said shaft means by one or more cable sheaves which are rigidly attached to said shaft means.

25. The method for making a pneumatically actuated swing ride according to claim 21, wherein said step of providing one or more pneumatic cylinder assemblies moveably attached to said shaft means by a lever arm which is rigidly attached to said shaft means, is deleted and replaced with the step of providing one or more pneumatic cylinder assemblies moveably attached to said shaft means by one or more chain sprockets which are rigidly attached to said shaft means.

26. The method for making a pneumatically actuated swing ride according to claim 21, wherein said step of providing base means for supporting vertical swing support columns further includes providing a support beam rigidly attached to said vertical swing support columns in a horizontal position above said shaft means, for allowing clearance for said passenger containment and securing means stabilizing yokes, whereby said support beam adds strength and stability to the overall swing ride structure.

* * * * *